US006514012B2

(12) United States Patent
Gregory et al.

(10) Patent No.: US 6,514,012 B2
(45) Date of Patent: Feb. 4, 2003

(54) SYSTEM AND METHOD FOR RAISING AND SUPPORTING A BUILDING AND CONNECTING ELONGATED PILING SECTIONS

(75) Inventors: Steven D. Gregory, Plano, TX (US); Christopher Wayne Bacon, Ada, OK (US); Robert Kent Pharr, Stonewall, OK (US)

(73) Assignee: Gregory Enterprise, Inc., Garland, TX (US)

( * ) Notice: Subject to any disclaimer, the term of this patent is extended or adjusted under 35 U.S.C. 154(b) by 0 days.

(21) Appl. No.: 09/741,689

(22) Filed: Dec. 19, 2000

(65) Prior Publication Data

US 2002/0076281 A1 Jun. 20, 2002

(51) Int. Cl.[7] ..... E02D 17/02

(52) U.S. Cl. ..... 405/230; 405/232; 405/251; 403/296

(58) Field of Search ..... 405/229, 230, 405/231, 232, 251, 250, 252.1, 253, 249; 403/296, 307, 299; 285/185

(56) References Cited

U.S. PATENT DOCUMENTS

| | | | | |
|---|---|---|---|---|
| 95,614 A | | 11/1869 | Spear | |
| 167,118 A | | 8/1875 | Pritchett | |
| 2,108,398 A | | 2/1938 | Allen, III | 287/20 |
| 2,815,852 A | * | 12/1957 | Harrer | 403/296 |
| 3,427,056 A | | 2/1969 | Cunningham | 287/54 |
| 3,519,292 A | | 7/1970 | Krikorian | 287/56 |
| 3,796,055 A | | 3/1974 | Mahony | 61/51 |
| 3,902,326 A | | 9/1975 | Langenbach, Jr. | 61/51 |
| 4,070,867 A | | 1/1978 | Cassidy | 61/53 |
| 4,157,230 A | * | 6/1979 | Tomt et al. | 405/252 |
| 4,254,597 A | * | 3/1981 | Feldman et al. | 405/251 |
| 4,257,308 A | | 3/1981 | Ornberg | 411/354 |
| 4,484,831 A | * | 11/1984 | Hanson, Jr. et al. | 403/296 |
| 4,634,319 A | | 1/1987 | May | 405/230 |
| 4,673,315 A | | 6/1987 | Shaw et al. | 405/230 |
| 4,695,203 A | | 9/1987 | Gregory | 405/230 |
| 4,735,527 A | * | 4/1988 | Bullivant | 405/232 |
| 4,765,777 A | | 8/1988 | Gregory | 405/230 |
| 4,810,144 A | | 3/1989 | Martelli | 411/182 |
| 4,826,343 A | | 5/1989 | Richards | 403/189 |
| 4,911,580 A | * | 3/1990 | Gregory et al. | 405/230 |
| 4,925,345 A | | 5/1990 | McCown, Jr. et al. | 405/232 |
| 4,952,092 A | | 8/1990 | Ballerstein | 403/174 |
| 5,080,313 A | | 1/1992 | Byrum et al. | 248/343 |
| 5,120,163 A | | 6/1992 | Holdeman et al. | 405/230 |
| 5,171,107 A | | 12/1992 | Hamilton et al. | 405/230 |
| 5,176,472 A | * | 1/1993 | Kinder | 405/230 |
| 5,230,581 A | | 7/1993 | Deng | 403/260 |
| 5,234,287 A | * | 8/1993 | Rippe, Jr. | 405/230 |
| 5,722,798 A | | 3/1998 | Gregory | 405/230 |
| 5,951,206 A | | 9/1999 | Gregory | 405/230 |
| 6,183,167 B1 | * | 2/2001 | Ruiz et al. | 405/251 |

FOREIGN PATENT DOCUMENTS

| | | | | |
|---|---|---|---|---|
| GB | 1 418 164 | | 1/1974 | |
| NL | 8702268 | * | 4/1989 | 405/251 |
| NO | 101614 | * | 5/1963 | 403/296 |
| SU | 1219728 | * | 3/1986 | 405/251 |

* cited by examiner

*Primary Examiner*—Heather Shackelford
*Assistant Examiner*—Frederick L. Lagman
(74) *Attorney, Agent, or Firm*—Haynes and Boone, LLP.

(57) ABSTRACT

This invention relates to a system and method for supporting a building and to a system and method for connecting sections, such as pilings, pipes, conduits, and the like, in an end-to-end, abutting, relationship to form pilings for the support system.

46 Claims, 5 Drawing Sheets

64
74
74
74
74
74
74
72
80

64
64a
72
80
60
70
62
62a 64
80b
8
72
70
8
62
80a

SYSTEM AND METHOD FOR RAISING AND SUPPORTING A BUILDING AND CONNECTING ELONGATED PILING SECTIONS

This invention relates to a system and method for raising and supporting a building and to a system and method for connecting elongated sections, such as pilings, conduits, and the like, in an end-to-end, abutting, relationship for form pilings for the raising and support system.

DETAILED DESCRIPTION

Figure 1:
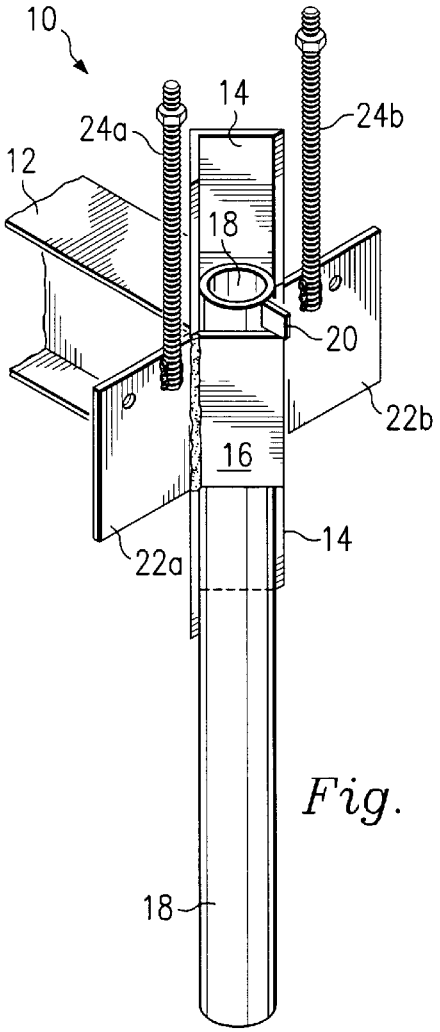
FIGS. 1–3 are isometric views depicting the raising and supporting system of the present invention in various stages of operation.

Referring specifically to FIG. 1 of the drawings, the reference numeral 10 refers, in general, to the lifting assembly of the present invention which includes a lifting arm 12, in the form of an l-beam, which extends under the foundation or slab to be lifted. A relatively long channel iron 14 is welded to one end of the lifting arm 12 and extends perpendicular thereto. A relatively short channel iron 16 is welded to the channel iron 14 along their respective corresponding longitudinal edges to define an opening for receiving a support sleeve 18. A lip 20 is welded to the upper end portion of the sleeve 18 which engages the channel iron 16 to maintain the sleeve in the position shown with the upper end portion extending slightly above the channel irons 14 and 16, for reasons to be explained.

Figure 2:
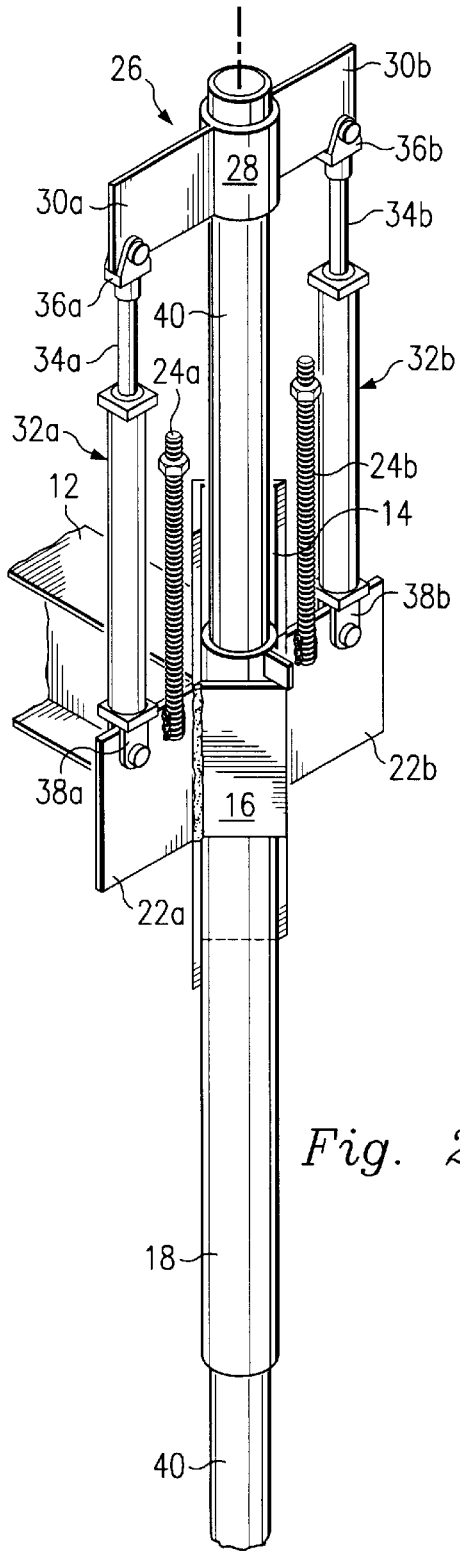

A pair of mounting plates 22*a* and 22*b* are welded to the respective corresponding welded edges of the channel irons 14 and 16 and each has an opening extending there through. A pair of threaded rods 24*a* and 24*b* are welded to the plates 22*a* and 22*b*, respectively and extend upwardly therefrom for reasons to be described. FIG. 2 depicts the apparatus of FIG. 1 with a hydraulic drive assembly mounted thereon. The reference numeral 26 refers, in general, to a driving, or clamping, assembly, which includes a gripping sleeve 28. Although not clear from the drawings, it is understood that the sleeve 28 is in the form of a conventional "slip bowl" for grabbing or clamping over a pipe and, as such, includes three inner arcuate inserts (not shown) which are tapered in a vertical direction so that they will grab, or clamp, a pipe segment of a predetermined diameter during downward movement, and slide over the pipe segment during upward movement, in a conventional manner. A pair of mounting plates 30*a* and 30*b* are connected to, and extend from, diametrically opposite portions of the sleeve 28 and each has an opening extending there through. This clamping assembly 26 is disclosed in more detail in applicant's U.S. Pat. No. 4,765,777, the disclosure of which is hereby incorporated by reference.

A pair of hydraulic ram units 32*a* and 32*b* are adapted for installation between the respective plates 22*a* and 30*a*, and the plates 22*b* and 30*b*. The ram units 32*a* and 32*b* include a pair of arms 34*a* and 34*b*, respectively, which are connected to pistons (not shown) which reciprocate in the ram units in response to actuation of the units, in a conventional manner. This reciprocal movement of the pistons causes corresponding movement of the arms 34*a* and 34*b* between the extended position shown in FIG. 2 and a retracted position.

The ram units 32*a* and 32*b* include a pair of devises 36*a* and 36*b* respectively, which are connected to the respective ends of the arms 34*a* and 34*b*. The devises 36*a* and 36*b* extend over the plates 30*a* and 30*b*, respectively and are connected to the latter plates by a pair of bolts. In a similar manner, a pair of devises 38*a* and 38*b* are connected to the lower ends of the ram units 32*a* and 32*b*, respectively, extend over the plates 22*a* and 22*b*, and are connected to the latter plates by a pair of bolts.

The sleeve 28 of the clamping assembly 26 extends around a piling, or pipe assembly, shown in general by the reference numeral 40 which comprises a plurality of pipe segments connected together in a conventional manner. Due to the tapered configuration of the above-described arcuate inserts, the clamping assembly 26 can be manually lifted upwardly on the piling assembly 40 without encountering substantial resistance. When the hydraulic ram units 32*a* and 32*b* are then retracted, the clamping assembly 26 moves downwardly over the piling assembly 40 and the inserts grab, or clamp, the outer surface of the pipe assembly and force it downwardly, as will be described in further detail later.

To install the lifting assembly 10, the area around the foundation to be lifted is initially excavated and the lifting assembly is placed in the excavated area with the lifting arm 12 extending underneath the house (not shown) and against the lower surface of the foundation. The sleeve 18 is inserted through the opening defined by the channel irons 14 and 16 and driven into the ground until the lip 20 engages the upper end of the channel iron 16. The sleeve can be driven manually or by use of the hydraulic ram units 32*a* and 32*b* in the manner described herein.

A section of the piling assembly 40 is then placed in the sleeve 18 and the clamping assembly 26 is placed over the upper portion of the piling assembly. The hydraulic ram units 32*a* and 32*b*, in their extended positions shown in FIG. 2, are then installed between the respective plates 22*a* and 30*a* and the plates 22*b* and 30*b*, respectively.

The ram units 32*a* and 32*b* are then actuated simultaneously to cause a retracting motion of their corresponding pistons, and therefore the arms 34*a* and 34*b*, to force the clamping assembly 26 downwardly. As a result, the sleeve 28 grabs the piling assembly 40 and forces it downwardly into the ground for a predetermined distance. The ram units 32*a* and 32*b* are then simultaneously actuated back to their expanded condition, moving the clamping assembly 26 upwardly to an upper portion of the piling assembly 40, and the sequence is repeated. During this sequential driving of the piling assembly 40 into the ground, additional pipe segments may be added to the assembly 40 as needed.

It is understood that a shim (not shown) can be inserted between the side wall of the foundation and the upper end portion of the channel iron 14 as needed to stabilize and align the system during the above operation.

Figure 3:
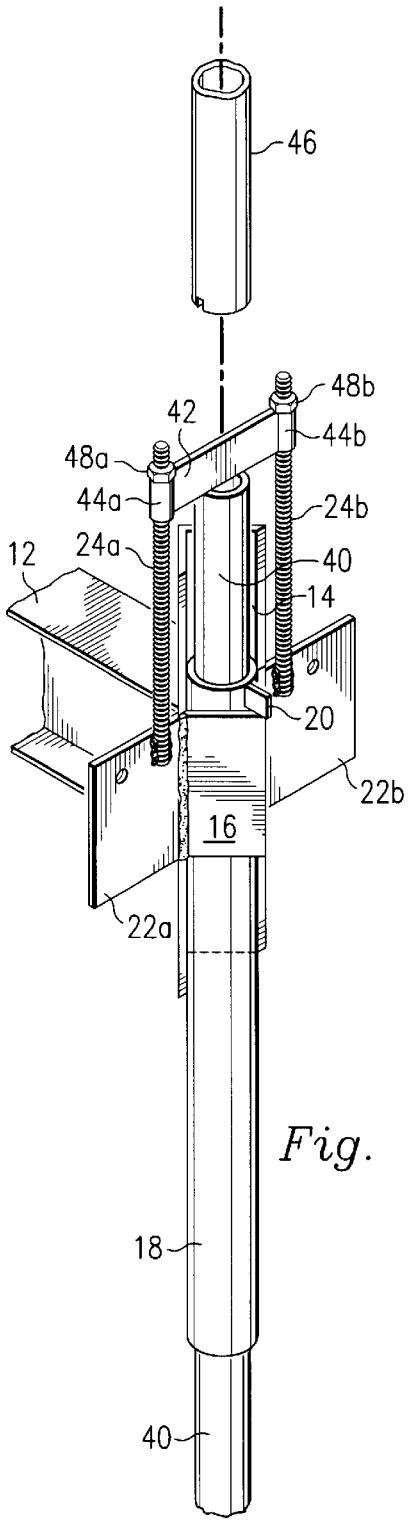
Figure 4:
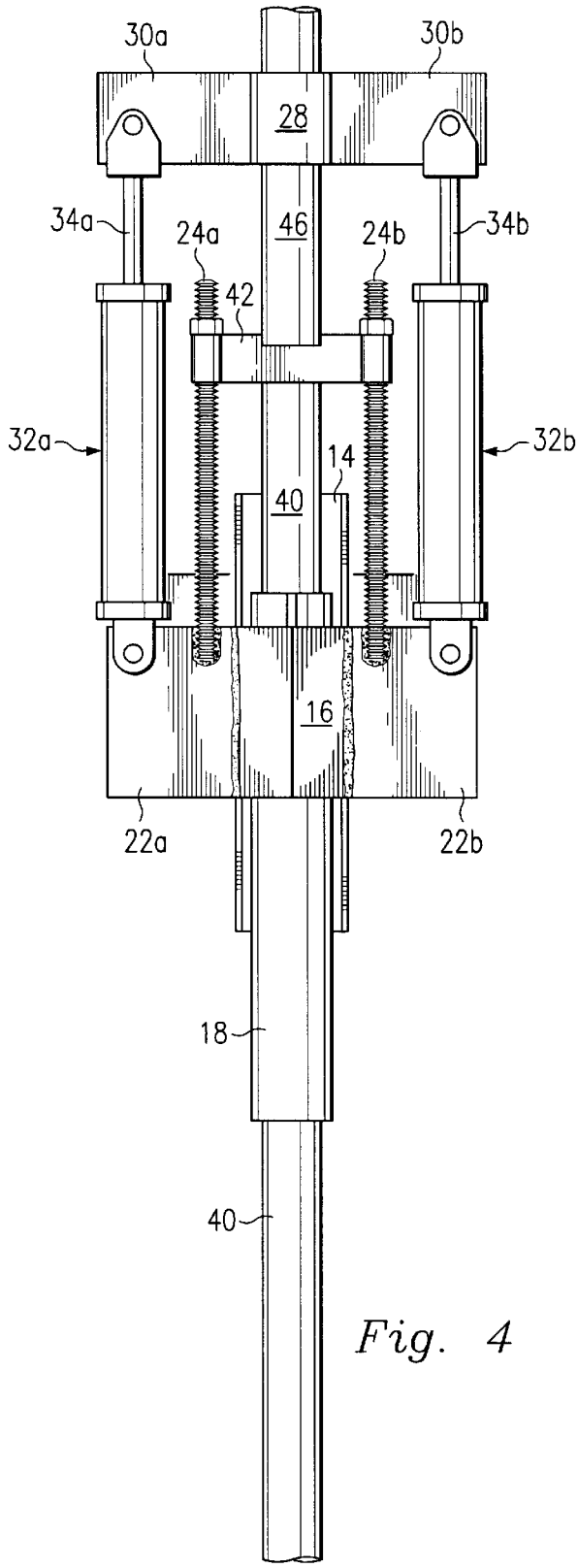
FIGS. 4 and 5 are front elevational views of the system of FIGS. 1–3 showing additional stages of operation.

The above procedure is repeated until the lower end portion of the piling assembly 40 encounters resistance in the ground, which is usually in the form of bedrock or the like, in which case the aforementioned driving movement is terminated. After resistance is encountered the procedure depicted in FIGS. 3 and 4 is initiated. More particularly, the upper segment of the piling assembly 40 is cut off so that a few inches extend above the upper end of the sleeve 18. A drive plate 42 having two sleeves 44*a* and 44*b* at its ends is positioned over the upper piling segment with its lower edge engaging the segment and with the sleeves 44*a* and 44*b* extending over the rods 24*a* and 24*b*, respectively. A drive pipe segment 46 is then placed over the plate 42, with notches in the former extending over the upper edge of the latter.

As shown in FIG. 4 the clamping assembly 26 and the hydraulic ram units 32*a* and 32*b* are installed in the manner described in connection with FIG. 2 with the sleeve 28 extending over the pipe segment 46. The arms 34*a* and 34*b* are expanded to the extent needed for the sleeve 28 to grasp the upper end portion of the pipe segment 46.

The ram units 32*a* are then retracted to exert a vertical force against the piling assembly 40 and therefore the plate 42 and the pipe segment 46. Since the piling assembly 40 can no longer be driven downwardly, the foundation will be lifted the desired amount causing the lifting arm 12, the channel iron 14 and 16, the plates 22*a* and 22*b*, and the rods 24*a* and 24*b* to move upwardly relative to the piling assembly 40, the plate 42, and the pipe segment 46 to the position shown in FIG. 5. Thus the plate 42 is spaced from its original position on the rods 24*a* and 24*b* a distance corresponding to the distance of the lift of the foundation.

Figure 5:
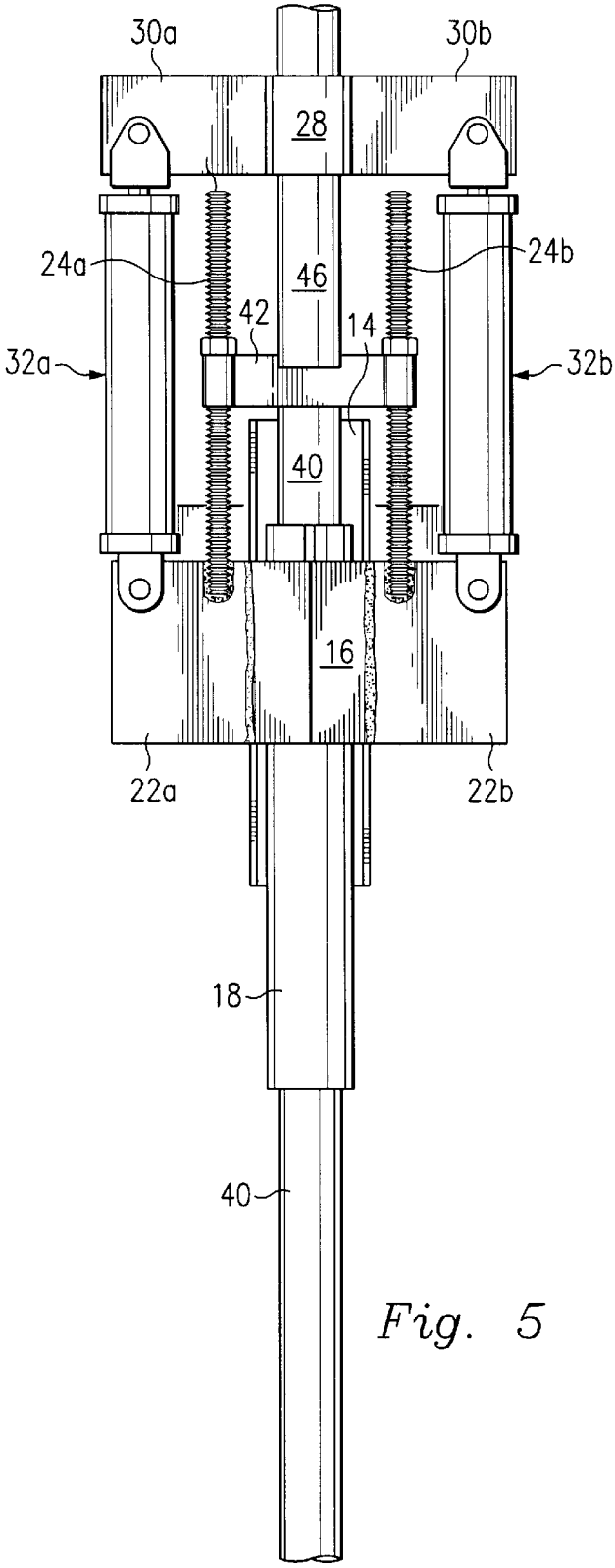

A pair of nuts 48*a* and 48*b* are then advanced downwardly over the rods 24*a* and 24*b*, respectively until they engage the plate 42 to secure the assembly in the position of FIG. 5. The hydraulic ram units 32*a* and 32*b* along with the clamping assembly 26 and the pipe segment 46 are then removed, and the area around the assembly is filed with dirt.

Although only one lifting assembly 10 is shown in the drawing it is understood that, in actual practice, several will be used at once at different locations along the foundation depending on the extent of the damage, in which case, after all of the piling assemblies 40 have been driven into the ground until they encounter resistance, all of the ram units 32*a* and 32*b* associated with the piling assemblies are simultaneously actuated again in the manner described in connection with FIGS. 4 and 5 to raise the foundation, and therefore the house, a predetermined distance.

Figures 6, 7, 8:
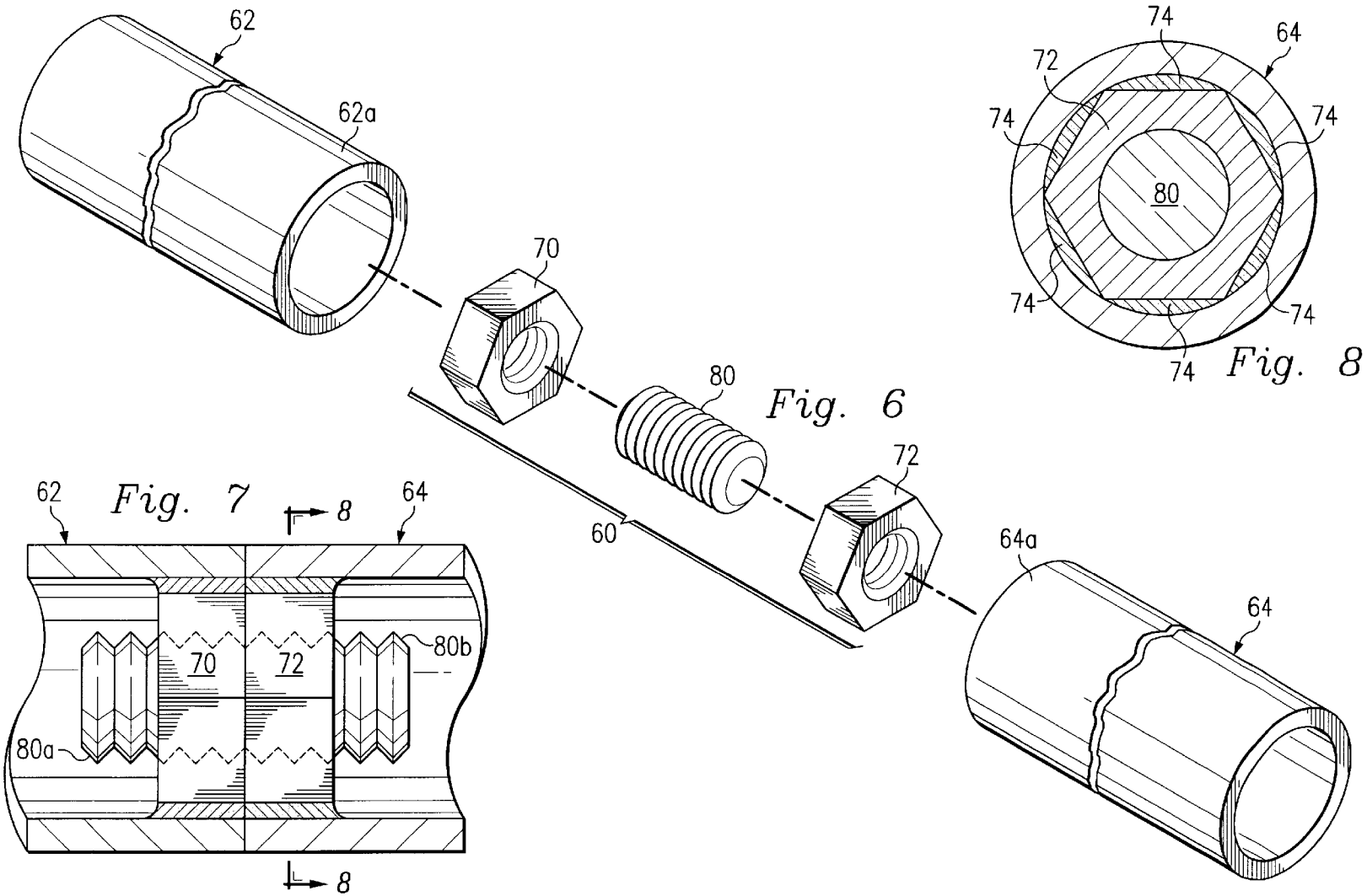
FIG. 6 is an exploded, isometric view of the connecting system according to an embodiment of the present invention shown with two elongated piling sections to be connected.
FIG. 7 is a partial, longitudinal sectional view of the system and sections of FIG. 6 shown in an assembled condition.
FIG. 8 is a cross-sectional view taken along the line 8—8 of FIG. 7.

With reference to FIGS. 6–8, the connecting system according to an embodiment of the present invention is shown, in general, by the reference numeral 60 and is adapted for connecting the corresponding ends of two piling sections 62 and 64 of the piling 40.

As shown in FIG. 7, the system 60 comprises two hexagonal fasteners 70 and 72 which are sized to extend in the end portions 62*a* and 64*a* of the sections 62 and 64, respectively. As shown in FIG. 8, the outer surface of each fastener 70 and 72 is hexagonal in shape, thus forming six planer surfaces and six angles, with the apexes of the angles between adjacent surfaces extending relative to the corresponding inner surfaces of the sections 62 and 64, respectively, with minimal clearance, as shown in FIG. 8 in connection with the fastener 72 and the section 64.

The fasteners 70 and 72 can be secured in the sections 62 and 64, respectively, by welding the outer planer surfaces of the fasteners to the corresponding inner surfaces of the sections. Due to the hexagonal outer surfaces of the fasteners 70 and 72, a plurality of weldments 74 are thus formed between the latter surfaces and the corresponding inner surfaces of the sections and between the above-mentioned apexes. The respective outer faces of the fasteners 70 and 72 extend flush with the corresponding ends of the sections 62 and 64 respectively, as shown in FIG. 8.

Each fastener 70 and 72 has an internally threaded bore, and an externally threaded rod 80 is provided which is sized to threadedly engage the bores of the fasteners as shown in FIG. 7. The length of rod 80 is at least equal to, or greater than, the combined widths of the fasteners 70 and 72. In the embodiment shown, in the assembled position of FIG. 7, the length of the rod 80 is greater than the combined widths of the fasteners 70 and 72, so that the end portions 80a and 80b of the rod 80 extend outwardly from the corresponding inner faces of the fasteners 70 and 72, respectively.

To assemble the sections 62 and 64 in an end-to-end abutting relationship as shown in FIG. 7, the fasteners 70 and 72 are secured in their respective end portions 62*a* and 64*a*, of the sections, as described above. Then, one end portion of the rod 80 is threadedly engaged with the outer face of the fastener 70 in the section 62, and the rod 80 is rotated relative to the fastener 70, or visa versa, so that the rod is advanced to an axial position relative to the fastener until the end portion 80*a* of the rod extends completely within the bore of the fastener, or until the end portion 80*a* extends outwardly from the inner face of the fastener as shown.

The other section 64, with the fastener 72 secured therein, is then moved to a position where the other end portion 80b of the rod 80 threadedly engages the outer face of the fastener 72. Then the rod 80 is rotated relative to the fastener 72, or visa versa, so that the rod is advanced to an axial position relative to the fastener 72 until the corresponding end of the elongated 64 abuts the corresponding end of the elongated 62. In this position, the end portion 80b of the rod 80 extends completely within the bore of the fastener 72, or extends outwardly from the inner face of the fastener as shown. Of course, the sections 62 and 64 can also be assembled by initially engaging the rod 80 with the fastener 72 in the section 64 and then engaging the rod with the fastener 70 in the section 62 in the manner described above.

Figure 9:
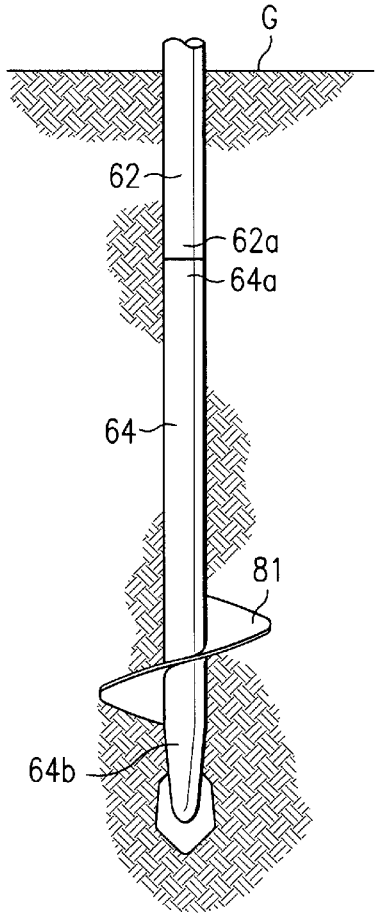
FIG. 9 is a partial elevational view of a building foundation installation utilizing the system of FIGS. 6–8.

It is understood that the connection system 60 can be used to connect pilings in other types of building raising and support systems. For example, in the arrangement of FIG. 9, the corresponding end portions 62*a* and 64*a* of the sections 62 and 64 are connected together by the system 60 in the manner described above, and at least one transversely-extending, load-bearing section, in the form of a metallic helix section 81, is secured, in any conventional manner, to the elongated section 64 near its other end portion 64*b*. The sections 62 and 64 and helix section 81 form an elongated earth screw anchor assembly that can penetrate the ground G in a conventional manner and can be utilized in conjunction with other equipment to support and stabilize a building structure which has or may experience settlement or movement.

Figure 10:
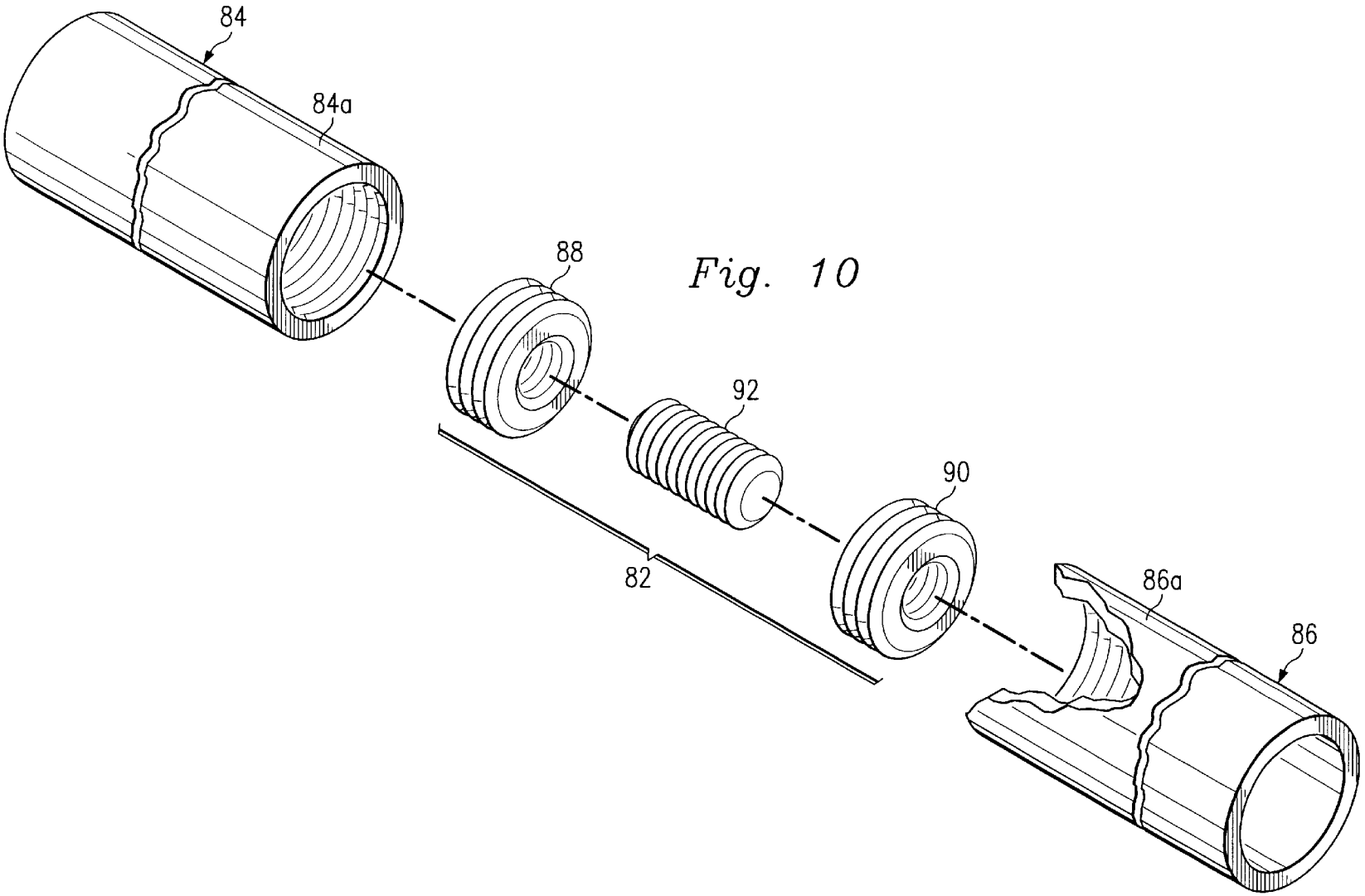
Fig. 10 is an exploded, isometric view of the connecting system according to an embodiment of the present invention shown with two elongated piling sections to be connected.

According to the embodiment of FIG. 10, a connecting system according to an alternate embodiment is shown, in general, by the reference numeral 82 and includes two piling sections 84 and 86 which have internally threaded end portions 84*a* and 86*a*, respectively. Two fasteners 88 and 90 are provided each of which has an externally threaded outer surface sized to threadedly engage the internally threaded end portions 84*a* and 86*a* of the end sections 84 and 86, respectively. Each fastener 88 and 90 also has an internally threaded bore, and an externally threaded rod 92 is provided which is sized to threadedly engage the latter bore of each of the fasteners.

To assemble the system 82 the fasteners 88 and 90 are threadedly engaged in the corresponding end portions of the sections 84 and 86. Then the respective end portions of the rod 92 are threadedly engaged in the fasteners 88 and 90 so that the each end portion of the rod extends into the sections 84 and 86 for an axial length sufficient to permit the corresponding ends of the sections 84 and 86, in the assembled condition of the system 82, to abut. Otherwise, the embodiment of FIG. 10 is identical to that of FIG. 6.

Still other examples of systems to raise and support buildings are disclosed in U.S. Pat. No. 5,951,206, U.S. Pat. No. 5,722,798, and U.S. Pat. No. 4,695,203, all assigned to the assignee of the present invention and all of which are hereby incorporated by reference. In this context, it is understood that in most installations of this type, multiple screw anchors, identical to the screw anchor described above, could also be used.

It is understood that variations may be made in the foregoing without departing from the scope of the invention, and examples of the variations are as follows:

The sections 62 and 64 of the piling 40 do not have to have a circular cross sections but can take other shapes such as rectangular, square, etc, in which case the outer surfaces of the fasteners 70 and 72 would be shaped accordingly.

The fasteners 70 and 72 are not limited to those having a hexagonal outer surface and the fasteners can be fastened into the interior of the sections 62 and 64 by other techniques, such as by as threaded connection or by adhesives, pins, clips, etc.

The outer surfaces of the fasteners 70 and 72 do not have to extend flush with the corresponding ends of the sections 62 and 64 respectively but rather can extend in the sections a predetermined distance.

The rod 80 can be directly welded into the interior of the section 62 and the fastener 72 attached to the section 64 as described above; after which the section 64/fastener 72 would be rotated relative to the rod 80, and therefore the section 72, until the corresponding end of the elongated 64 abuts the corresponding end of the elongated 72.

The length of the rod 80 can be varied so that, in the assembled condition of the sections 62 and 64, the ends of the rod at least extend flush with the corresponding inner faces of the fasteners 70 and 72, respectively, or outwardly from the latter faces a predetermined distance, including the distance shown in FIG. 7.

The sections 62 and 64 are not limited to pilings sections, but could be in the form of any other type of tubular members such as pipes, conduits, etc. for transporting fluid, etc.

The raising and supporting system 10 of the present invention can also be used in an identical manner to raise a concrete slab extending underneath the entire area of a building or a house. In the case of a concrete slab, the system 10 would be mounted on an outer wall of the slab.

The clamping assembly 26 can be replaced with a block, or driving section that engages the upper end of the piling 40 and, when forced downwardly by the ram units 32*a* and 32*b*, drives the assembly into the ground.

An external drive system can be provided to drive the sleeve 25 and then the piling 40 into the ground until a predetermined resistance is encountered, after which the ram units 32*a* and 32*b* can be installed and activated to raise the foundation or slab in the manner described above.

Since other modifications, changes, and substitutions are intended in the foregoing disclosure, it is appropriate that the appended claims be construed broadly and in a manner consistent with the scope of the invention.

What is claimed is:

1. A system for raising and supporting the foundation or slab of a building, the system comprising a lifting arm assembly for engaging the lower surface of the foundation or slab, the lifting arm assembly comprising a support sleeve, a piling section extending through the support sleeve, means for applying a load to the piling section to drive a portion of the piling section into the ground; and a connection assembly for connecting the piling section to an additional piling section in response to the portion of the piling section being driven into the ground, the connection assembly comprising a first connecting member secured in one of the piling sections, a second connecting member secured in the other piling section, and a third connecting member connecting the first and second connecting members, and therefore the piling sections in an abutting, end-to-end relationship wherein each of the piling sections are internally threaded and wherein the first and second connecting members have external threads that threadedly engage the internal threads of the corresponding piling sections to secure the first and second connecting members to their corresponding piling sections.

2. The system of claim 1 wherein each of the first and second connection members has an internally threaded bore and wherein the third connecting member is an externally threaded rod adapted to threadedly engage the bores of the first and second connection members to secure the piling sections in the abutting, end-to-end relationship.

3. The system of claim 1 wherein the first and second connecting members are welded within their respective piling sections.

4. The system of claim 3 wherein the outer surface of each of the first and second connecting members has a plurality of planar surfaces with a angle extending between adjacent planer surfaces, the apexes of the angles extending in their corresponding piling sections with minimal clearance.

5. The system of claim 4 wherein the weldments extend between the planer surfaces of the connecting members and the corresponding inner surfaces of the corresponding piling section and between adjacent apexes.

6. The system of claim 1 where the outer face of each of the first and second connection member extends substantially flush with the end of the corresponding piling section.

7. The system of claim 1 further comprising means for securing each connecting member to its corresponding piling section.

8. The system of claim 7 wherein the means is selected from the group consisting of at least one weldment, thread, clip, and adhesive.

9. The system of claim 1 further comprising clamping means engaging said upper portion of said piling section, ram means connected between said clamping means and said lifting arm assembly, and means for actuating said ram means to drive said piling sections into the ground until the first-mentioned piling section encounters a predetermined resistance.

10. The system of claim 9 further comprising at least one rod extending from the lifting arm assembly, and a plate slidably mounted relative to said rod and adapted for connection to each of said piling sections for movement therewith, said actuating means adapted to further actuate said ram means after said predetermined resistance is encountered to raise said lifting arm, said foundation or slab and said rod a predetermined distance relative to said piling sections and said plate.

11. The system of claim 10 further comprising means for securing said rod in said raised position relative to said plate to secure said foundation in its raised position.

12. The system of claim 9 wherein the piling has an upper portion extending above the support sleeve and a lower portion extending below the support sleeve and into the ground.

13. The apparatus of claim 9 wherein said lifting arm assembly further comprises an arm member for engaging the foundation or slab, a first channel member secured to said arm member, and a second channel member secured to said first channel member to form an opening for receiving said support sleeve.

14. The apparatus of claim 9 wherein said ram means is normally, in an, expanded position, and wherein said actuating means retracts said ram means to drive said piling section.

15. The apparatus of claim 1 wherein said ram means comprises two ram assemblies extending on opposite sides of said piling section.

16. A method for raising and supporting the foundation or slab of a building, the system comprising engaging the lower surface of the foundation or slab with a lifting arm including a support sleeve, inserting a piling section into the support sleeve, applying a load to the piling section to drive the piling section into the ground, threadedly engaging a first connecting member with the piling section, threadedly engaging a second connecting member with another piling section, and connecting the first and second connecting members with a third connecting member to connect the piling sections in an abutting, end-to-end relationship.

17. The method of claim 16 further comprising providing a internally threaded bore in each of the first and second connection members, and providing external threads on the third connecting member which threadedly engage the bores of the first and second piling sections to secure the piling sections in the abutting, end-to-end relationship.

18. The method of claim 16 wherein the step of securing comprises the step of welding the first and second connecting members to their respective piling sections.

19. The method of claim 16 further comprising positioning the first and second connecting members relative to their respective piling sections so that the outer face of each first and second connecting members extends substantially flush with the end of the corresponding piling section.

20. A system for connecting two elongated, internally threaded, tubular sections in an abutting end-to-end relationship, the system comprising a first externally threaded connecting member in one of the tubular sections in threaded engagement therewith, a second externally threaded connecting member in the other tubular section in threaded engagement wherewith, and a third connecting member connecting the first and second connecting members, and therefore the tubular sections in an abutting, end-to-end relationship.

21. The system of claim 20 wherein each of the first and second connection members has an internally threaded bore and wherein the third connecting member is an externally threaded rod adapted to threadedly engage the bores of the first and second connection members to secure the tubular sections in the abutting, end-to-end relationship.

22. The system of claim 20 wherein the first and second connecting members are welded within their respective tubular sections.

23. The system of claim 22 wherein the outer surface of each of the first and second connecting members has a plurality of planar surfaces with a angle extending between adjacent planer surfaces, the apexes of the angles extending in their corresponding tubular sections with minimal clearance.

24. The system of claim 23 wherein the weldments extend between the planer surfaces of the connecting members and the corresponding inner surfaces of the corresponding tubular section and between adjacent apexes.

25. The system of claim 20 where the outer face of each of the first and second connection member extends substantially flush with the end of the corresponding tubular section.

26. The system of claim 20 further comprising means for securing each connecting member to its corresponding tubular section.

27. The system of claim 26 wherein the means is selected from the group consisting of at least one weldment, thread, clip, and adhesive.

28. A method for connecting two elongated tubular sections in an abutting end-to-end relationship, comprising providing internal threads on the tubular sections, providing external threads on an exterior surface of a first and a second connecting member, threadedly engaging the first connecting member in one of the tubular sections, threadedly engaging the second connecting member in the other tubular section, and connecting the first and second connecting members with a third connecting member to connect the tubular sections in an abutting, end-to-end relationship.

29. The method of claim 28 further comprising providing a internally threaded bore in each of the first and second connection members, and providing external threads on the third connecting member which threadedly engage the bores of the first and second tubular sections to secure the tubular sections in the abutting, end-to-end relationship.

30. The method of claim 28 wherein the step of securing comprises the step of welding the first and second connecting members to their respective tubular sections.

31. The method of claim 28 further comprising positioning the first and second connecting members relative to their respective tubular sections so that the outer face of each first and second connecting members extends substantially flush with the end of the corresponding tubular section.

32. A building foundation installation comprising:

a first piling having a helix section formed at one end thereof for penetrating the ground; the other end portion of the piling being internally threaded;

an externally threaded connecting member in threaded engagement with the internally threaded other end portion of the piling;

a second piling for supporting a load and having an internally threaded end portion;

an externally threaded connecting member in threaded engagement with the internally threaded end portion of the second piling; and a third connecting member connecting the first and second connecting members, and therefore the pilings, in an abutting, end-to-end relationship.

33. The system of claim 32 wherein each of the first and second connection members has an internally threaded bore and wherein the third connecting member is an externally threaded rod adapted to threadedly engage the bores of the first and second connection members to secure the tubular sections in the abutting, end-to-end relationship.

34. The system of claim 32 wherein the first and second connecting members are welded within their respective tubular sections.

35. The system of claim 34 wherein the outer surface of each of the first and second connecting members has a plurality of planar surfaces with a angle extending between adjacent planer surfaces, the apexes of the angles extending in their corresponding tubular sections with minimal clearance.

36. The system of claim 35 wherein the weldments extend between the planer surfaces of the connecting members and the corresponding inner surfaces of the corresponding tubular section and between adjacent apexes.

37. The system of claim 32 where the outer face of each of the first and second connection member extends substantially flush with the end of the corresponding tubular section.

38. The system of claim 32 further comprising means for securing each connecting member to its corresponding tubular section.

39. The system of claim 38 wherein the means is selected from the group consisting of at least one weldment, thread, clip, and adhesive.

40. A system for raising and supporting the foundation or slab of a building, the system comprising:

a lifting assembly comprising:

means for engaging the foundation or slab; and a support sleeve connected to the engaging means; and a piling assembly extending through the support sleeve and comprising:

a first piling section, a helix secured to the first piling section and adapted to penetrate the ground, a first internally threaded connecting member secured in the first piling section, a second piling section, a second internally threaded connecting member secured in the second piling section, and a third externally threaded connecting member connecting the first and second connecting members, and therefore the piling sections, in an abutting, end-to-end relationship; and a driving mechanism for driving the piling assembly, including the helix section, into the ground until a predetermined resistance is encountered.

41. The apparatus of claim 40 further comprising means to exert a force between the lifting assembly and the ground to raise the lifting arm and the foundation.

42. The system of claim 41 further comprising means for securing the lifting assembly in the raised position.

43. The apparatus of claim 40 wherein the lifting assembly further comprises means secured to the engaging means and forming an opening for receiving the support sleeve.

44. The system of claim 40 wherein the first and second connecting members are welded to their respective piling sections.

45. The system of claim 40 wherein the outer surface of each of the first and second connecting members has a plurality of planar surfaces with a angle extending between adjacent planer surfaces, the apexes of the angles extending in their corresponding piling sections with minimal clearance.

46. The system of claim 45 wherein the weldments extend between the planer surfaces of the connecting members and the corresponding inner surfaces of the corresponding piling section and between adjacent apexes.

* * * * *